US008061983B1

(12) United States Patent
Bowers et al.

(10) Patent No.: US 8,061,983 B1
(45) Date of Patent: Nov. 22, 2011

(54) EXHAUST DIFFUSER STRUT WITH STEPPED TRAILING EDGE

(75) Inventors: Martin W Bowers, Jupiter, FL (US); Barry J Brown, Jupiter, FL (US)

(73) Assignee: Florida Turbine Technoligies, Inc., Jupiter, FL (US)

( * ) Notice: Subject to any disclaimer, the term of this patent is extended or adjusted under 35 U.S.C. 154(b) by 718 days.

(21) Appl. No.: 12/142,894

(22) Filed: Jun. 20, 2008

(51) Int. Cl.
*F03B 3/18* (2006.01)

(52) U.S. Cl. ..... 415/211.2

(58) Field of Classification Search ..... 415/211.2
See application file for complete search history.

(56) References Cited

U.S. PATENT DOCUMENTS 6,309,180 B1 * 10/2001 Gilliland et al. ..... 415/208.2

* cited by examiner

*Primary Examiner* — George Fourson, III
(74) *Attorney, Agent, or Firm* — John Ryznic

(57) ABSTRACT

A diffuser for a turbo machine, such as an exhaust diffuser for an industrial gas turbine engine, the diffuser including a plurality of struts connecting the inner shroud of the diffuser to the outer shroud, where the struts have trailing edges with a step shape to reduce the losses and improve the performance of the diffuser. The stepped shaped trailing edge includes three or more steps with the middle step being the longest in the chordwise direction and the remaining steps being symmetric about the chord of the strut.

7 Claims, 2 Drawing Sheets

EXHAUST DIFFUSER STRUT WITH STEPPED TRAILING EDGE

FEDERAL RESEARCH STATEMENT

None.

CROSS-REFERENCE TO RELATED APPLICATIONS

None.

BACKGROUND OF THE INVENTION

1. Field of the Invention

The present invention relates generally to a diffuser, and more specifically to an exhaust axial flow diffuser for a gas turbine engine.

2. Description of the Related Art Including Information Disclosed Under 37 CFR 1.97 and 1.98

In a turbomachine, such as a compressor or a turbine or a gas turbine engine, a diffuser is used in several locations to improve the airflow either into or out of a turbomachine. Inlet diffusers are used to slow down the airflow entering a compressor. Outlet diffusers are used to limit backflow pressure and therefore improve the flow exiting the turbomachine. An industrial gas turbine engine makes use of an axial flow diffuser at the exit of the engine to improve the performance of the engine. The exhaust from the turbine enters the exhaust diffuser and therefore is hot gas flow. A typical exhaust diffuser in an IGT includes a plurality of struts extending between the outer shroud and the inner shroud that forms the diffuser flow path. In an IGT—which is a large and heavy engine—these struts can be quite thick compared to other turbomachine airfoils. In the exhaust flow of the diffuser, a wake is formed behind each of the struts due to flow separation that will lower the performance of the engine.

Prior art diffuser struts for a large diffuser have thick struts with a standard blunt trailing edge shape as seen in FIG. 1. This type of strut can reduce the incident angle losses. The losses behind this blunt trailing edge strut are excessive. Another prior art diffuser has cross sectional shapes of an airfoil which includes a trailing edge that tapers down to a point as seen in FIG. 2. This improves the airflow around the strut to limit vortices from developing that reduce the efficiency by increasing the backflow pressure. One problem with the tear drop shaped prior art strut of FIG. 2 is a shorter life for the strut. The strut is exposed to the hot exhaust gas flow exiting the engine. The sharp edge of this trailing edge shaped strut will be affected by erosion or corrosion much more than would a blunt trailing edge of FIG. 1.

BRIEF SUMMARY OF THE INVENTION

It is an object of the present invention to provide for an improved diffuser over that of the prior art.

It is another object of the present invention to improve the life of a strut used in an exhaust diffuser exposed to a hot exhaust gas flow.

It is another object of the present invention to improve the overall performance of an industrial gas turbine engine.

It is another object of the present invention to reduce the flow separation of a strut in a diffuser.

The present invention is a diffuser having a number of struts that connect the inner and outer shrouds that form the diffuser flow path in which the struts have a stepped trailing edge shape that reduces the backpressure of a blunt shaped trailing edge but improves the life for the strut over that of the tear drop shaped trailing edge strut. The struts of the present invention can also be used in inlet diffuser or outlet diffuser of compressor as well as in turbine. The stepped trailing edge shaped struts are especially useful in struts that have thick walls.

DETAILED DESCRIPTION OF THE INVENTION

Figure 4:
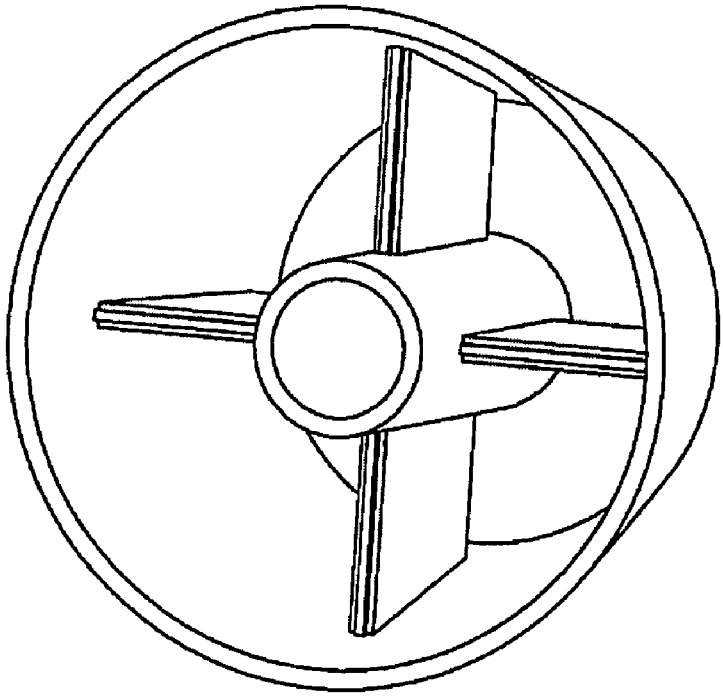
FIG. 4 shows a schematic view of an exhaust diffuser with the strut of the present invention.

The diffuser of the present invention is shown in FIG. 4 which represents a section of the actual exhaust diffuser used in an industrial gas turbine engine. The diffuser includes an inner shroud and an outer shroud that defines the flow path through the diffuser. A number of struts connect the inner shroud to the outer shroud to form a rigid structure for the exhaust flow. In a typical IGT exhaust diffuser, 3 to 5 struts are used to support the structure. In an IGT exhaust diffuser, the struts are thick members that have a slight airfoil shape.

Figure 3:
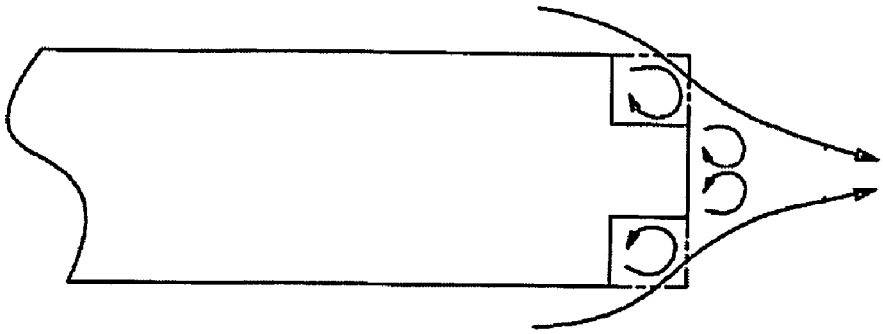
FIG. 3 shows a cross section view of a strut having the step shaped trailing edge of the present invention.

FIG. 3 shows a cross section view of the trailing edge section of one of the struts with the step shaped trailing edge. In the present invention, the trailing edge includes three steps with a middle step having a longer chordwise length and the two steps on the sides having shorter but equal chord lengths. The stepped trailing edge (TE) extends along the entire strut spanwise direction in which the exhaust flow passes around the strut. The step shaped trailing edge extends along the entire strut from the inner to the outer shroud surfaces. The three step portions of the trailing edge have about the same thickness when measured from one side of the strut to the other side. In this embodiment, three steps are shown. However, more than three steps can be formed into the trailing edge if warranted or desired for improved performance.

FIG. 4 shows a schematic view of the diffuser looking from the rear or exhaust end. Four struts are used to connect the outer shroud to the inner shroud and are offset from each other by around 90 degrees. The inner shroud is around a constant diameter from the axial center of the diffuser while the outer shroud increases in diameter in the downstream or exhaust flow of the diffuser to form a conical cross sectional shaped gas flow passage. This is a typical shape for an exhaust diffuser. The trailing edges of the four struts are shown in FIG. 4 with the stepped shaped trailing edges. The number of struts can vary depending upon the structural integrity and vary from three to five, but can even be more than five if desired.

Figure 1:
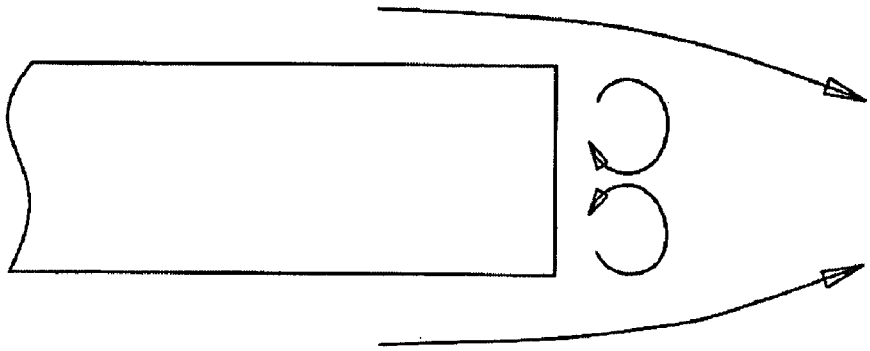
Fig 1 PRIOR ART
FIG. 1 shows a cross section view of a strut of the prior art having a blunt trailing edge.
Figure 2:
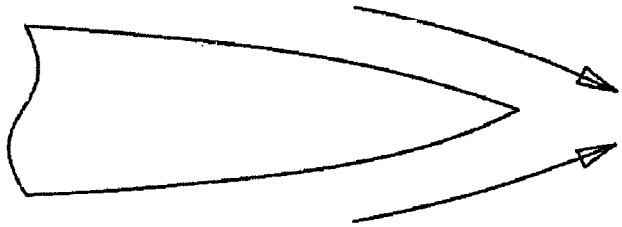
Fig 2 PRIOR ART
FIG. 2 shows a cross section view of a strut of the prior art having a tear drop shaped trailing edge.

The performance of the strut with the stepped TE can be seen compared to the blunt shaped TE of FIG. 1. The airflow rejoins at a location closer to the TE of the strut in the present invention than in the prior art strut of FIG. 1. The wake is shorter in the present invention strut than in the prior art strut of FIG. 1. A shorter wake lowers the backflow pressure and therefore increases the efficiency of the diffuser, which thus increases the efficiency of the gas turbine engine.

The present invention is described above for use as an exhaust diffuser in an industrial gas turbine engine. However, the stepped TE strut could be used in an exhaust diffuser of an aero engine, or in an inlet or outlet diffuser for a compressor to improve the performance of the diffuser and therefore the turbomachine.

We claim the following:

1. An exhaust diffuser for a gas turbine engine comprising:

An inner shroud and an outer shroud forming a conical airflow section with a conical cross sectional shape;

A plurality of struts connecting the inner shroud to the outer shroud and located within the gas flow passage, each struts having a trailing edge with a stepped cross sectional shape to improve performance of the diffuser.

2. The exhaust diffuser of claim 1, and further comprising:

The struts are struts in a large frame heavy duty industrial gas turbine engine.

3. The exhaust diffuser of claim 1, and further comprising:

The trailing edge includes at least three steps with the middle step having the longest chordwise length and the remaining steps being symmetric about the chord of the strut.

4. A diffuser for a turbomachine comprising:

An inner shroud and an outer shroud forming a conical airflow section with a conical cross sectional shape;

A plurality of struts connecting the inner shroud to the outer shroud and located within the gas flow passage, each struts having a trailing edge with a stepped cross sectional shape to improve performance of the diffuser.

5. The diffuser of claim 4, and further comprising:

The trailing edge includes at least three steps with the middle step having the longest chordwise length and the remaining steps being symmetric about the chord of the strut.

6. The diffuser of claim 4, and further comprising:

The diffuser is an inlet diffuser for a compressor.

7. The diffuser of claim 4, and further comprising:

The diffuser is an outlet diffuser for a turbine.

* * * * *